US005771956A

United States Patent [19]

Kimura

[11] Patent Number: 5,771,956

[45] Date of Patent: Jun. 30, 1998

[54] COOLING LINE APPARATUS FOR COOLING MOLDS FILLED WITH MOLTEN METAL

[75] Inventor: Kunimasa Kimura, Fujieda, Japan

[73] Assignee: Sintokogio, Ltd., Nagoya, Japan

[21] Appl. No.: 672,268

[22] Filed: Jun. 27, 1996

[30] Foreign Application Priority Data

Jun. 30, 1995 [JP] Japan ..... 7-187926

[51] Int. Cl.[6] ..... B22D 5/00; B22D 46/00

[52] U.S. Cl. ..... 164/323; 164/154.3

[58] Field of Search ..... 164/323, 322, 164/154.3, 348, 129, 458

[56] References Cited

U.S. PATENT DOCUMENTS 3,627,028 12/1971 Carignan ..... 164/323

FOREIGN PATENT DOCUMENTS 52-9576 3/1977 Japan .

57-159259 10/1982 Japan ..... 164/323

*Primary Examiner*—Joseph J. Hail, III

*Assistant Examiner*—I.-H. Lin

*Attorney, Agent, or Firm*—Limbach & Limbach L.L.P.

[57] ABSTRACT

A simplified apparatus of cooling lines is disclosed. A plurality of cooling lines ($Z_1$–$Z_4$) are disposed between two parallel lines, a teeming line (X) and a mold-removing line (V). A mold sending-in line (Y) is disposed to connect the end portion of the teeming line and the starting portions of the cooling lines. A mold sending-out line (U) is disposed to connect the end portions of the cooling lines and the starting portion of the mold-removing line (V). A first transfer device (4) runs along the mold sending-in line (Y), while a second transfer device (6) runs along the mold sending-out line (U). Opposing electric servo-cylinders (15, 29) are mounted on a transfer truck (9) of the first transfer device (4) and a transfer truck (23) of the second transfer device (6).

2 Claims, 2 Drawing Sheets

COOLING LINE APPARATUS FOR COOLING MOLDS FILLED WITH MOLTEN METAL

FIELD OF THE INVENTION

This invention relates to an apparatus of cooling lines for cooling molds filled with molten metal for use at an automatic foundry plant which produces ductile casts.

DESCRIPTION OF THE PRIOR ART

When products such as ductile casts, which take a long time to be cooled, are produced, preferably a plurality of cooling lines are arranged to maintain the rate of molding and the rate of charging molten metal in molds, and to minimize a required cooling line area. Japanese Patent B (KOKOKU), 52-9576 discloses an apparatus having a plurality of cooling lines. In the apparatus molds which are transferred along a teeming line are moved onto a mold sending-in line which is disposed transversely of the teeming line. The molds, which are filled with molten metal at the teeming line, and which are moved along the mold sending-in line, are then transferred to a plurality of cooling lines, which are disposed transversely of the mold sending-in line and parallel to the teeming line. The molds are successively transferred on each cooling line in a direction opposite to their stream in the teeming line, and are transferred to a mold sending-out line which is disposed transversely of the end portions of the cooling lines. The molds are sent out from the mold sending-out line to undergo the next step.

In the cooling lines of the apparatus a pusher and a shock absorber are disposed both at the starting portion and end portion of each cooling line wherein the pusher pushes each mold filled with molten metal while the shock absorber absorbs the force of inertia of each mold. Thus the apparatus uses many pushers and shock absorbers, and is therefore complicated.

This invention is conceived considering this drawback. The purpose of this invention is to simplify the structure of the cooling line apparatus for cooling molds filled with molten metal for use at an automatic foundry plant which produces ductile cast products.

SUMMARY OF THE INVENTION

To the above end, this invention uses a first and second mold-transfer device at the mold sending-in line and the mold sending-out line, respectively. An electric servo-cylinder is mounted on each mold sending-in and sending-out line. The electric servo-cylinder acts as a pusher to push a mold, and as a shock absorber when it receives a mold. The apparatus of the present invention includes a plurality of cooling lines which are disposed between a teeming line and a mold-removing line substantially parallel to the teeming line, and which are arranged substantially parallel to the teeming line, a mold sending-in line which connects an end portion of the teeming line to the starting portions of the cooling lines, and a mold sending-out line which connects end portions of the cooling lines to a starting portion of the mold-removing line. The apparatus further includes a first and a second transfer device that run along the mold sending-in and sending-out lines, respectively.

The first transfer device includes a first transfer truck, a railroad which is mounted on the first transfer truck and connectable to the end portion of the teeming line and the starting portions of the cooling lines, and along which a mold-carrying truck runs, and a first inwardly-facing electric servo-cylinder disposed rearward of the railroad. The second transfer device includes a second transfer truck, a railroad which is mounted on the second transfer truck and connectable to the end portions of the cooling lines and the starting portion of the mold-removing line, and along which a mold-carrying truck runs, and a second inwardly-facing electric servo-cylinder disposed rearward of the railroad of the second transfer device.

The molds filled with molten metal are transferred by the first and second transfer devices from the teeming line through the cooling lines to the mold-removing line. The present invention does not require pushers and shock absorbers for all cooling lines. Thus the cooling lines are simplified.

DESCRIPTION OF THE PREFERRED EMBODIMENT

The preferred embodiment of the present invention now will be explained in detail.

Figure 1:
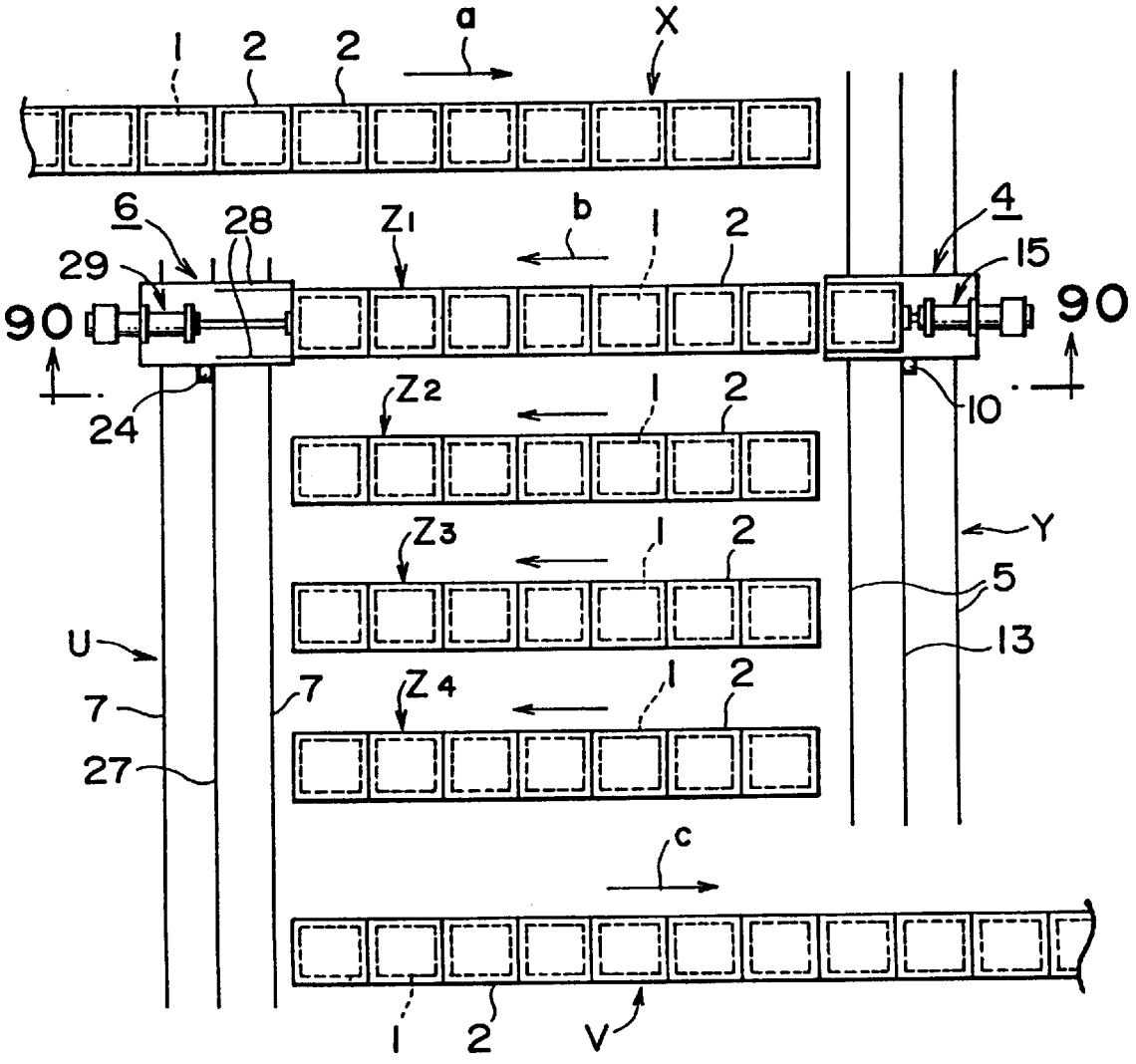
FIG. 1 is a plan view of the embodiment of the apparatus of the invention at an automatic foundry plant.
Figure 2:
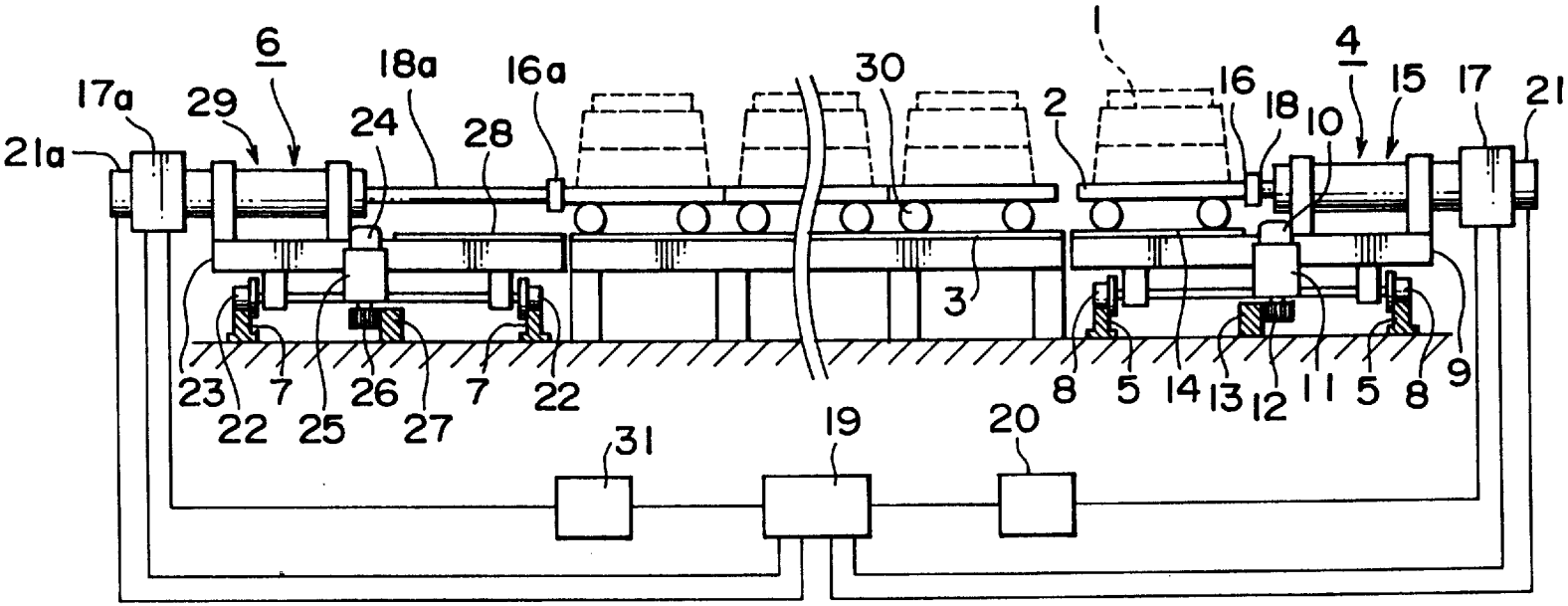
FIG. 2 is a cross-sectional view along arrow A—A in FIG. 1.

In FIG. 1 a teeming line X is shown. It is connected to a molding station (not shown) at an upstream end thereof. A group of trucks 2, which carry molds, are put in a line on a railroad (not shown) of the teeming line through their wheels 30 (see FIG. 2). The mold-carrying-trucks 2 are successively pushed one by one by a pusher (a hydraulic cylinder, not shown) in the direction shown by arrow a, and are filled with molten metal at a teeming station (not shown), which is located midway in the teeming line.

Z in FIG. 1 denotes a plurality of cooling lines arranged parallel to the teeming line X. On the lines groups of the trucks 2, which carry the molds filled with molten metal, are arranged along a railroad 3 as in FIG. 2. The trucks 2 stay on the cooling lines for a predetermined period to cool the mold filled with the molten metal. The number of lines Z is determined considering the cooling period of the molds. In the embodiment, four lines, $Z_1$–$Z_4$, are used as in FIG. 1.

Y denotes a mold sending-in line which connects the end portion (downstream end) of the teeming line X to the starting portions (upstream ends) of the cooling lines $Z_1$–$Z_4$. On the mold sending-in line Y a first transfer device 4 is disposed to run on a railroad 5 along the mold sending-in line Y to transfer the mold-carrying-trucks 2 on the line Y to each of the cooling lines $Z_1$–$Z_4$.

V denotes a mold-removing line disposed parallel to the teeming line X such that the cooling lines $Z_1$–$Z_4$ are positioned between the teeming line X and the mold-removing line V. A group of mold-carrying trucks 2, which carry the cooled molds, are arranged in a line on a railroad (not shown) along the mold-removing line V. The trucks 2 are successively transferred along the line V in the direction of arrow c, and the sand of the molds is removed from cast products at a mold-removing station.

U denotes a mold sending-out line which connects the end portions (downstream ends) of the cooling lines $Z_1$–$Z_4$ to the starting portion (upstream end) of the mold-removing line V. A second transfer device 6 is disposed to run on a railroad 7 along the mold sending-out line U so that it transfers the mold-carrying trucks 2 on each of the cooling lines $Z_1$–$Z_4$ to the mold-removing line V.

The first transfer device 4 is now explained in detail. The device 4 includes a transfer truck 9 which runs along the railroad 5 through wheels 8 thereof. A pinion 12, a servomotor 10, and reduction gears 11, are secured to a side of the transfer truck 9. The pinion 12 is driven to rotate in a horizontal plane by the servomotor 10 and the reduction gears 11. The pinion 12 is meshed with a rack 13 which extends along the railroad 5. When the servomotor is driven, the transfer truck 9 reciprocates on the railroad 5. The transfer truck 9 can stop both at the end portion of the teeming line X and the starting portion of each of the cooling lines $Z_1$–$Z_4$.

A railroad 14 is disposed on the transfer truck 9 at its left side (inside). The railroad 14 is connectable to an end portion of a railroad (not shown) of the teeming line X and to the starting portion of the railroad 3 of each of the cooling lines $Z_1$–$Z_4$. Only one mold-carrying truck 2 can run along the railroad 14. An inwardly facing electric servo-cylinder 15, which has a rod head facing inwardly, is mounted on the transfer truck 9 at its right side.

The electric cylinder 15 is operated by the clockwise and counterclockwise rotations of the servomotor 17 so that the piston rod 18 extends and retracts. A controller 19 switches the rotational direction of the servomotor 17. The rotational speed of the servomotor 17, i.e., the rate of the extension and retraction of the piston rod 18, is controlled by the controller 19 via an inverter 20 (a device to change the frequency to energize the servomotor). Further, the number of rotations of the servomotor 17, i.e., the rate of the extension and retraction of the piston rod 18, is controlled by the controller 19 via an encoder 21 (a device for detecting the number of rotations of the servomotor 17).

The electric cylinder 15 is programmed so that it acts as a shock absorber when the first transfer device 4 is at the end portion of the teeming line X, and as a pusher when the first transfer device is at one of the cooling lines $Z_1$–$Z_4$.

The second transfer device 6 is now explained in detail. It includes a transfer truck 23 which runs on the railroad 7 through its wheels 22. A pinion 26, a servomotor 24, and reduction gears 25, are secured to a side of the transfer truck 23. The pinion 26 is driven in a horizontal plane by the servomotor 24 and reduction gears 25. The pinion 26 is meshed with a rack 27 which extends along the railroad 7 so that the transfer truck 23 reciprocates on the railroad 7 when the servomotor is driven. The transfer truck 23 can stop at the end portion of each of the cooling lines $Z_1$–$Z_4$ and at the starting portion of the mold-removing line V.

A railroad 28 is disposed on the transfer track 23 at its right side (inner side) so that only one mold-carrying truck 2 can run on the railroad 28. The railroad 28 is connectable to the end portion of the railroad 3 of each of the cooling lines $Z_1$–$Z_4$and to the starting portion of a railroad (not shown) of the mold-removing line V. An inwardly-facing electric servo-cylinder 29 having a rod head 16*a* facing inwardly is disposed on the transfer track 23 at its left side.

Since the structure of the cylinder 29 is the same as that of the electric servo-cylinder 15, the same elements are denoted by the same numbers, but with the attached "a."

The clockwise and counterclockwise rotations of the servomotor 17*a* cause the piston rod 18*a* of the electric cylinder 29 to extend and retract. The controller 19 switches the rotational direction of the servomotor 17*a*. The rotational speed of the servomotor 17, i.e., the rate of the extension and retraction of the piston rod 18*a*, is controlled by the controller 19 via an inverter 31 (a device to change the frequency to energize the servomotor). Further, the number of rotations of the servomotor 17*a*, i.e., the rate of the extension and retraction of the piston rod 18*a*, is controlled by the controller 19 via an encoder 21*a* (a device for detecting the number of rotations of the servomotor 17*a*).

The electric cylinder 29 is programmed so that it acts as a shock absorber when the second transfer device 6 is at the end portion of any one of the cooling lines $Z_1$–$Z_4$, and as a pusher when it is at the starting portion of the mold-removing line V.

In the above automatic foundry plant, as a first step, the first transfer device 4 is connected to the end portion of the teeming line X, and the piston rod 18 of the electric servo-cylinder 15 is extended so that it almost comes into contact with the leading truck 2 of the group of mold-carrying trucks 2 on the teeming line X. After this, as a second step, the piston rod of a pusher (not shown) is extended, while the servomotor 17 of the cylinder 15 is then rotated counterclockwise to retract its piston rod 18. Thus the mold-carrying trucks 2 are moved to the right as shown by arrow a, and the leading truck 2 is transferred onto the railroad 14 of the first transfer device 4.

At this time, the frequency to energize the servomotor 17 is controlled such that the rate of retraction of the piston rod 18 is reduced per a predetermined time-rate curve, while the trucks 2, pushed by the pusher hydraulic cylinder), move at a high speed due to the force of inertia. Thus the leading truck 2 is strongly pushed to the rod head 16 of the electric servo-cylinder 15. As a result, the servomotor 17 rotates at a rate higher than its own primary rate. A reaction from the servomotor, i.e. a torque in a direction opposite to the rotation of the servomotor, brakes the leading truck 2. Thus the speed of the group of mold-carrying trucks 2 on the teeming line X gradually becomes less, and they finally stop. Therefore, the leading truck 2 is moved onto the first transfer device 4 without any damage due to the shock caused when the truck is strongly pushed to the rod head. In a third step, a pushing-back device (not shown) pushes back all the trucks 2 on the teeming line X other than the leading truck, to separate the other trucks from the leading one and to make a space therebetween.

In a fourth step, the servomotor 10 of the first transfer device 4 is activated to move the device 4 to the starting portion of the cooling line $Z_1$, while the servomotor 17 of the electric servo-cylinder 15 is rotated clockwise. In a fifth step, the piston rod 18 of the electric cylinder 15 is extended to the maximum, thereby pushing and sending out the mold-carrying truck 2, which is on the railroad 14 of the first transfer device 4, onto the railroad 3 of the cooling line $Z_1$. After this, the piston rod 18 is retracted. By repeating steps 1 through 5, many mold-carrying trucks 2 are arranged in a line on the cooling line $Z_1$. Similarly, many mold-carrying trucks 2 are arranged in lines on the cooling lines $Z_2$, $Z_3$, and $Z_4$.

Next, a procedure to transfer the mold-carrying trucks 2 on the cooling lines $Z_1$–$Z_4$ onto the mold-removing line V is explained. In a step 6, the first transfer device 4, which has received a new mold-carrying truck 2, is connected to the starting portion of the cooling line $Z_1$, and the servomotor 17 of the electric servo-cylinder 15 is switched to the clockwise rotation mode. In a seventh step, the second transfer device 6 is connected to the starting portion of the cooling line $Z_1$, and the piston rod 18*a* of the electric servo-cylinder 17 of the device 6 is extended so that the rod head 16 almost comes into contact with the leading truck 2 of the group of mold-carrying trucks 2. The servomotor 17*a* of the cylinder 29 is switched to the counterclockwise rotation mode (this state is shown in FIG. 1).

In an eighth step, the servomotor 17 of the electric servo-cylinder 15 of the first transfer device 4 is rotated clockwise to extend the piston rod 18, while the servomotor 17*a* of the electric servo-cylinder 29 of the second transfer device 6 is rotated counterclockwise to retract the piston rod 18*a*. By these operations, the group of mold-carrying trucks 2 on the cooling line $Z_1$ is moved in the direction shown by arrow b by means of the mold-carrying truck 2 on the first transfer device 4.

At this movement of the trucks 2, the frequency to energize the servomotor 17*a* is controlled such that the rate of retraction of the piston rod 18*a* is reduced per a predetermined time-rate curve, and the group of the mold-carrying trucks 2 runs at a high speed due to the force of inertia. Thus the leading truck 2 is strongly pushed to the rod head 16*a* of the electric servo-cylinder 29. As a result, the servomotor 17*a* rotates at a rate higher than its own primary rate. A reaction torque from the servomotor 17*a* brakes the group of mold-carrying trucks 2. Thus their speed is gradually reduced, and they finally stop. Therefore, the leading truck 2 is transferred onto the second transfer device 6 without any damage due to the shock.

In a ninth step, a pushing-back device (not shown) pushes back all the trucks 2 other than the leading truck, to make a space therebetween. In a tenth step, the second transfer device 6 is moved to the end portion of the mold-removing line V, and the servomotor 17*a* of the electric cylinder 29 of the device 6 is switched to the clockwise rotation mode. In an eleventh step, the piston rod 18*a* of the electric cylinder 29 is extended to push the mold-carrying truck 2 on the second transfer device 6 onto the mold-removing line V. After this, the piston rod 18*a* is retracted.

By repeating the above sixth to eleventh steps, the group of the mold-carrying trucks 2 on the cooling line $Z_1$ is transferred onto the mold-removing line V. After the trucks 2 are moved from the cooling line $Z_1$, a new group of mold-carrying trucks 2 is transferred from the teeming line X onto the cooling line $Z_1$. Similarly, the groups of the mold-carrying trucks 2 on the cooling lines $Z_2$, $Z_3$, and $Z_4$ are transferred onto the mold-removing line V.

One skilled in the art will appreciate that besides the described embodiment the present invention can be practiced by any other embodiment. For example, instead of sets of the rack and pinion, sets of a ball screw and nut may be used to move the first and second transfer devices along their railroads. The described embodiments are given for illustration and not for limitation, and the present invention is limited only by the following claims:

What we claim is:

1. An apparatus of cooling lines for cooling molds filled with molten metal that comprises a plurality of cooling lines ($Z_1$–$Z_4$) arranged substantially parallel to a teeming line (X) and disposed between the teeming line (X) and a mold-removing line (V), which is disposed substantially parallel to the teeming line (X), a mold sending-in line (Y) which connects an end portion of the teeming line to starting portions of the cooling lines, and a mold sending-out line (U) which connects end portions of the cooling lines to a starting portion of the mold-removing line, wherein the apparatus further comprises:

a first transfer device (4) which runs along the mold sending-in line (Y), the first transfer device including a first transfer truck (9), a railroad (14) which is mounted on the first transfer truck and connectable to the end portion of the teeming line and the starting portions of the cooling lines, and along which a mold-carrying truck (2) runs, and a first inwardly-facing electric servo-cylinder (15) disposed rearward of the railroad (14); and a second transfer device (6) which runs along the mold sending-out line (U), the second transfer device including a second transfer truck (23), a railroad (28) which is mounted on the second transfer truck and connectable to the end portions of the cooling lines and the starting portion of the mold-removing line, and along which a mold-carrying truck (2) runs, and a second inwardly-facing electric servo-cylinder (29) disposed rearward of the railroad (28) of the second transfer device.

2. The apparatus of claim 1 that further comprises means (19, 20, 21, 21*a*, 31) for controlling the rate and degree of extension and retraction of piston rods of the first and second electric servo-cylinders.

* * * * *